US006494740B1

(12) United States Patent
Murakami et al.

(10) Patent No.: US 6,494,740 B1
(45) Date of Patent: Dec. 17, 2002

(54) WATERPROOF CONNECTOR AND FABRICATION METHOD THEREOF

(75) Inventors: Takao Murakami, Shizuoka-ken (JP); Masaru Fukuda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/280,447

(22) Filed: Mar. 30, 1999

(30) Foreign Application Priority Data

Mar. 31, 1998 (JP) ..... 10-087112

(51) Int. Cl.[7] ..... H01R 13/40

(52) U.S. Cl. ..... 439/587; 439/275

(58) Field of Search ..... 439/587, 589, 439/274, 275, 271, 273

(56) References Cited

U.S. PATENT DOCUMENTS

| | | | | |
|---|---|---|---|---|
| 3,879,239 A | | 4/1975 | Rager et al. | 156/73.1 |
| 4,083,902 A | | 4/1978 | Clyde | 264/26 |
| 4,640,567 A | | 2/1987 | Lundergan et al. | 339/94 |
| 4,643,506 A | | 2/1987 | Kobler | 339/94 |
| 4,662,629 A | | 5/1987 | Plovie | 272/62 |
| 4,662,692 A | | 5/1987 | Uken et al. | 339/96 |
| 4,664,461 A | * | 5/1987 | Schubert et al. | 439/587 |
| 4,684,187 A | | 8/1987 | Rudy, Jr. et al. | 439/600 |
| 4,708,662 A | | 11/1987 | Klein | 439/353 |
| 4,713,021 A | | 12/1987 | Kobler | |
| 4,776,813 A | * | 10/1988 | Wilson et al. | 439/587 |
| 4,944,688 A | | 7/1990 | Lundergan | 439/275 |
| 4,969,260 A | | 11/1990 | Kondo et al. | 29/863 |
| 4,976,634 A | | 12/1990 | Green et al. | 439/589 |
| 4,979,913 A | | 12/1990 | Aiello et al. | 439/596 |
| 5,116,236 A | | 5/1992 | Colleran et al. | 439/271 |
| 5,120,269 A | | 6/1992 | Endo et al. | 439/752 |
| 5,215,635 A | | 6/1993 | Stein et al. | 204/157.62 |
| 5,240,431 A | | 8/1993 | Yagi et al. | 439/271 |
| 5,266,045 A | | 11/1993 | Yamanoto et al. | |
| 5,316,504 A | | 5/1994 | Jinno | 439/752 |
| 5,419,722 A | | 5/1995 | Onoda | 439/752 |
| 5,490,572 A | | 2/1996 | Tajiri et al. | 180/65.1 |
| 5,498,170 A | | 3/1996 | Tanaka | 439/271 |

(List continued on next page.)

FOREIGN PATENT DOCUMENTS

| | | |
|---|---|---|
| EP | 0 299 797 | 1/1989 |
| EP | 0 546 753 A1 | 6/1993 |
| EP | 0 631 344 A2 | 6/1994 |
| EP | 0 691 710 A2 | 1/1996 |
| EP | 0 700 125 A2 | 3/1996 |
| FR | 2 415 375 | 1/1979 |
| FR | 2753008 | 3/1998 |
| GB | 2 168 548 A | 6/1986 |
| GB | 2 321 346 A | 7/1998 |
| GB | 2 321 792 A | 8/1998 |
| GB | 2 321 802 A | 8/1998 |
| JP | 61-12621 | 4/1986 |

(List continued on next page.)

OTHER PUBLICATIONS

European Search Report, Jul. 8, 1999.

*Primary Examiner*—Neil Abrams
*Assistant Examiner*—J. F. Duverne
(74) *Attorney, Agent, or Firm*—Finnegan, Henderson, Farabow, Garrett & Dunner, L.L.P.

(57) ABSTRACT

Terminals (14) are connected to electric wires (13), a connector housing (12) has chambers (11) for accommodating the terminals (14) and an opening **(12*a*) for passing the electric wires (13), and a soft sealing material (15) seals the opening (12*a*) with its sealing configuration. The soft sealing material (15) has insertion holes (21) for the terminals (14) to be inserted therethrough to the chambers (11), and is deformed from its initial configuration in which a respective insertion hole (21) is larger in section than a corresponding terminal (14), to the sealing configuration in which the respective insertion hole (21) has an identical section to an electric wire (13) connected to the corresponding terminal (14)**.

9 Claims, 5 Drawing Sheets

U.S. PATENT DOCUMENTS

| | | | | | |
|---|---|---|---|---|---|
| 5,529,508 | A | | 6/1996 | Chiotis et al. | 439/204 |
| 5,562,477 | A | | 10/1996 | Moore et al. | 439/383 |
| 5,569,050 | A | | 10/1996 | Lloyd | 439/465 |
| 5,580,264 | A | | 12/1996 | Aoyama et al. | 439/275 |
| 5,596,261 | A | | 1/1997 | Suyama | 320/48 |
| 5,613,868 | A | * | 3/1997 | Ohsumi et al. | 439/275 |
| 5,634,807 | A | * | 6/1997 | Saito | 439/275 |
| 5,634,808 | A | * | 6/1997 | Shinji | 439/277 |
| 5,645,451 | A | | 7/1997 | Ohsumi et al. | 439/587 |
| 5,707,251 | A | | 1/1998 | Sakai et al. | 439/589 |
| 5,709,563 | A | * | 1/1998 | Saito | 439/275 |
| 5,730,627 | A | | 3/1998 | Okabe | 439/752 |
| 5,766,039 | A | * | 6/1998 | Abe | 439/587 |
| 5,782,657 | A | | 7/1998 | Wolla et al. | 439/595 |
| 5,803,773 | A | | 9/1998 | Kashiyama et al. | 439/752 |
| 5,836,788 | A | | 11/1998 | Torii | 439/587 |
| 5,860,834 | A | | 1/1999 | Sugiyama | 439/595 |
| 5,931,699 | A | * | 8/1999 | Saito et al. | 439/587 |
| 5,931,707 | A | | 8/1999 | Ito | 439/752 |
| 5,947,774 | A | | 9/1999 | Abe | 439/701 |
| 5,984,737 | A | | 11/1999 | Nagano et al. | 439/752 |

FOREIGN PATENT DOCUMENTS

| | | |
|---|---|---|
| JP | 62-188069 | 11/1987 |
| JP | 64-63282 | 3/1989 |
| JP | 4-49480 | 4/1992 |
| JP | 4-101380 | 9/1992 |
| JP | 5-152028 | 6/1993 |
| JP | 6-217412 | 8/1994 |
| JP | 6-295750 | 10/1994 |
| JP | 7-22079 | 1/1995 |
| JP | 7-122331 | 5/1995 |
| JP | 07201395 | 8/1995 |
| JP | 7-298450 | 11/1995 |
| JP | 07326424 | 12/1995 |
| JP | 8-186901 | 7/1996 |
| JP | 9-45376 | 2/1997 |
| JP | 09082394 | 3/1997 |
| JP | 10-92478 | 4/1998 |
| WO | WO 96/32760 | 10/1996 |
| WO | WO 97/36346 | 10/1997 |

* cited by examiner

WATERPROOF CONNECTOR AND FABRICATION METHOD THEREOF

BACKGROUND OF THE INVENTION

1. Field of the Invention

The present invention relates to a waterproof connector of a type in which a connector housing has a terminal accommodation chamber sealed with a "body of elastic and soft sealing material" (hereafter simply called "soft sealing material"), as well as to a fabrication method of the same.

2. Description of Relevant Art

This type of waterproof connector is disclosed in Japanese Patent Application Laid-Open Publication No. 64-63282.

A conventional waterproof connector of the type comprises a connector housing formed with a number of terminal accommodation chambers having a wire draw-out opening or outlet, a number of terminals accommodated in the chambers and connected to electric wires inset through the outlet, and a soft sealing material for sealing the wire outlet of the chambers. The soft sealing material comprises a body of gel, such as of a silicon, filling up gaps between the wires and walls of the outlet, getting in tight-contact with circumferences of the wires and the outlet walls, preventing water drops or droplets from invading the terminal accommodation chambers along wire circumferences and/or outlet walls.

The soft sealing material is inset at a side of the housing where the wires are drawn out. It is kept from falling off, with a retention member engaging with a rear end part of the housing. The sealing material has a plurality of normally close cross-cut slits provided therethrough for the terminals to be guided therealong inside the accommodation chambers, as well as for the wires to be sealed watertight with cut surfaces of the slits contacting thereon. The slits have corresponding positions to the terminal accommodation chambers.

For assemblage, the soft sealing material is first inserted from a rear end opening of the wire outlet and set in the outlet, where it is brought into watertight contact with walls of the outlet, before the retention member is likewise set.

Then, the terminals, which have been attached to the wires in a separate process, are applied at their front ends into rear ends of the cross slits, and are pushed forward through the slits, with forces, so that they are guided toward and fit inside the terminal accommodation chambers and the wires are provided through the sealing material, extending along the slits.

As the terminals are pushed, they scrape off surfaces of the slits in the soft sealing material, carrying scraps of the material inside the terminal accommodation chambers. Such scraps constitute an obstacle to the connection between the above terminals and mating terminals, and increase contact resistances therebetween. Further, scraped surfaces of the slits cause a deteriorated performance of the waterproof connector.

SUMMARY OF THE INVENTION

The present invention has been achieved with such points in view.

It therefore is an object of the invention to provide a waterproof connector free of scrapes of a soft sealing material by a terminal, as well as of scraps of the soft sealing material carried in a terminal accommodation chamber.

It also is an object of the invention to provide a method for fabrication of a waterproof connector to be free of scrapes of a soft sealing material by a terminal, as well as of scraps of the soft sealing material carried in a terminal accommodation chamber.

To achieve the object, an aspect of the invention provides a waterproof connector comprising a terminal connected to an electric wire, a housing having a chamber for accommodating the terminal and an opening for passing the electric wire, a soft sealing body for sealing the opening with a sealing configuration thereof, the soft sealing body having an insertion hole for the terminal to be inserted therethrough to the cahmber, and means for deforming the soft sealing body from an initial configuration thereof, where the insertion hole is larger in section than the terminal, to the sealing configuration, where the insertion hole has an identical section to the electric wire.

According to the aspect of the invention, the terminal connected to the electric wire can be inserted to the chamber through the insertion hole which is larger in section than the terminal in the initial configuration of the soft sealing body, without scraping an inside of the insertion hole nor carrying scraps to the chamber, before a deformation of the soft sealing body to the sealing configuration in which the insertion hole has an identical section to the electric wire, so that an effective sealing is achieved around the electric wire, as well as to the opening.

To achieve the object, another aspect of the invention provides a waterproof connector fabrication method comprising the steps of providing a housing having a chamber with an opening, connecting a terminal to an electric wire, providing a soft sealing body with an initial configuration thereof having an insertion hole larger in section than the terminal, inserting the terminal through the insertion hole to the chamber, thereby accommodating the terminal in the chamber with the electric wire passing the opening, and deforming the soft sealing body from the initial configuration thereof to a sealing configuration thereof in which the insertion hole has an identical section to the electric wire, thereby sealing the opening.

According to this aspect also, there can be achieved like effects to that aspect.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIG. 1A and FIG. 1B show a waterproof connector according to a first embodiment of the invention, in which FIG. 1A is a cross-sectional view of a connector in a state before a soft sealing material is pressed, and FIG. 1B is a cross-sectional view of a connector in a state after the soft sealing material is pressed;

FIG. 3A and FIG. 3B show the soft sealing material of the first embodiment, in which FIG. 3A is a section along line IIIa—IIIa of FIG. 1A, and FIG. 3B is a section along line IIIb—IIIb of FIG. 1B.

FIG. 4A and FIG. 4B show a waterproof connector according to a second embodiment of the invention, in which FIG. 4A is a cross-sectional view of a connector in a state before a soft sealing material is pressed, and FIG. 4B is a cross-sectional view of a connector in a state after the soft sealing material is pressed;

DETAILED DESCRIPTION OF THE PREFERRED EMBODIMENTS

Figure 1A:
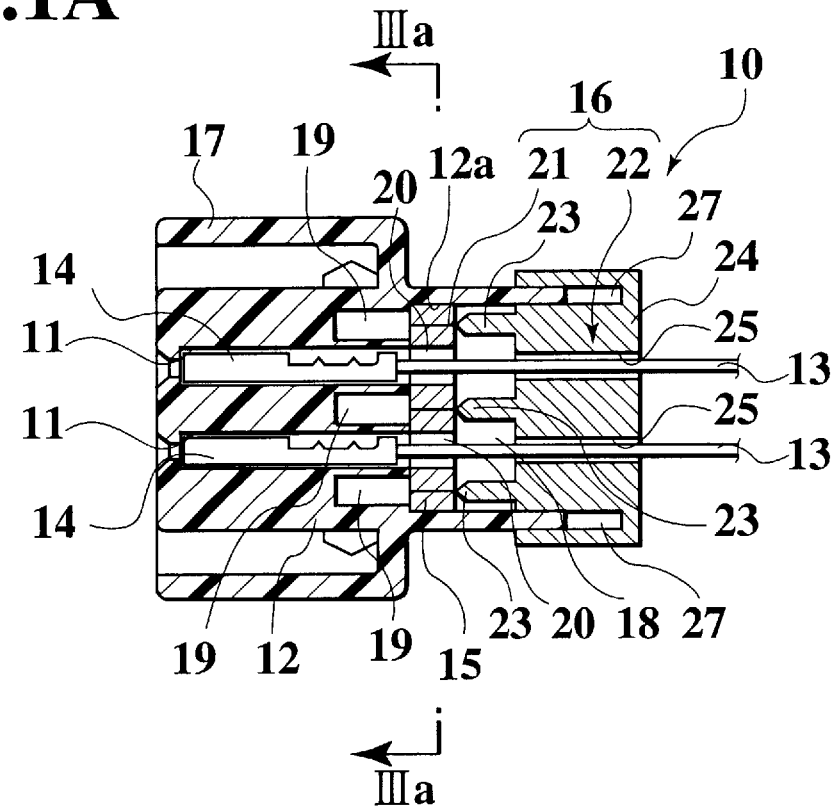

There will be detailed below waterproof connectors according to the preferred embodiments of the present invention with. reference to the accompanying drawings. Like members are designated by like reference characters.

Figure 1B:
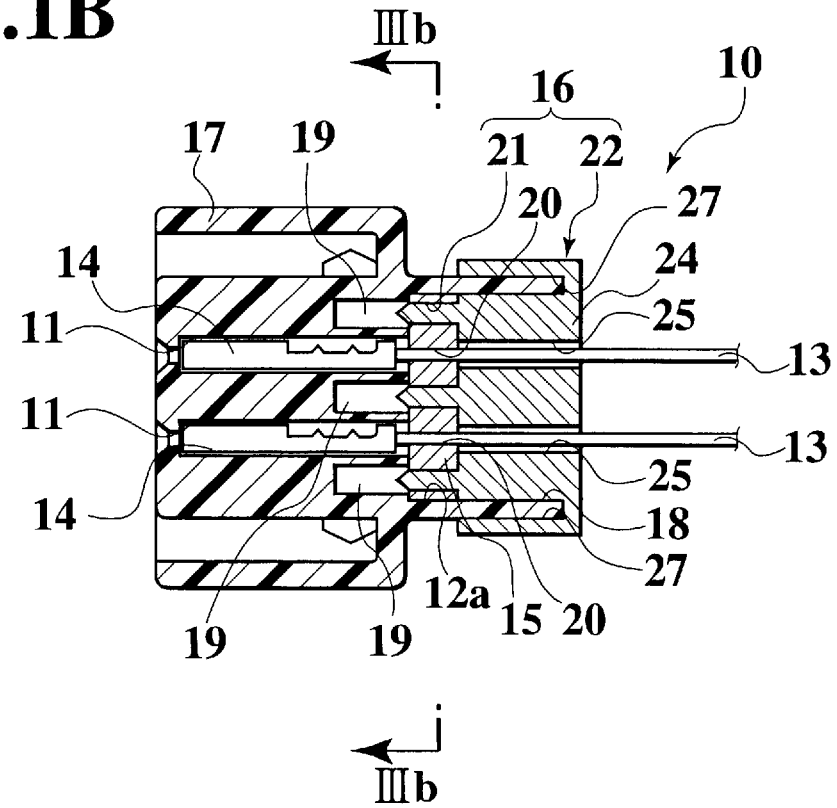
Figure 2:
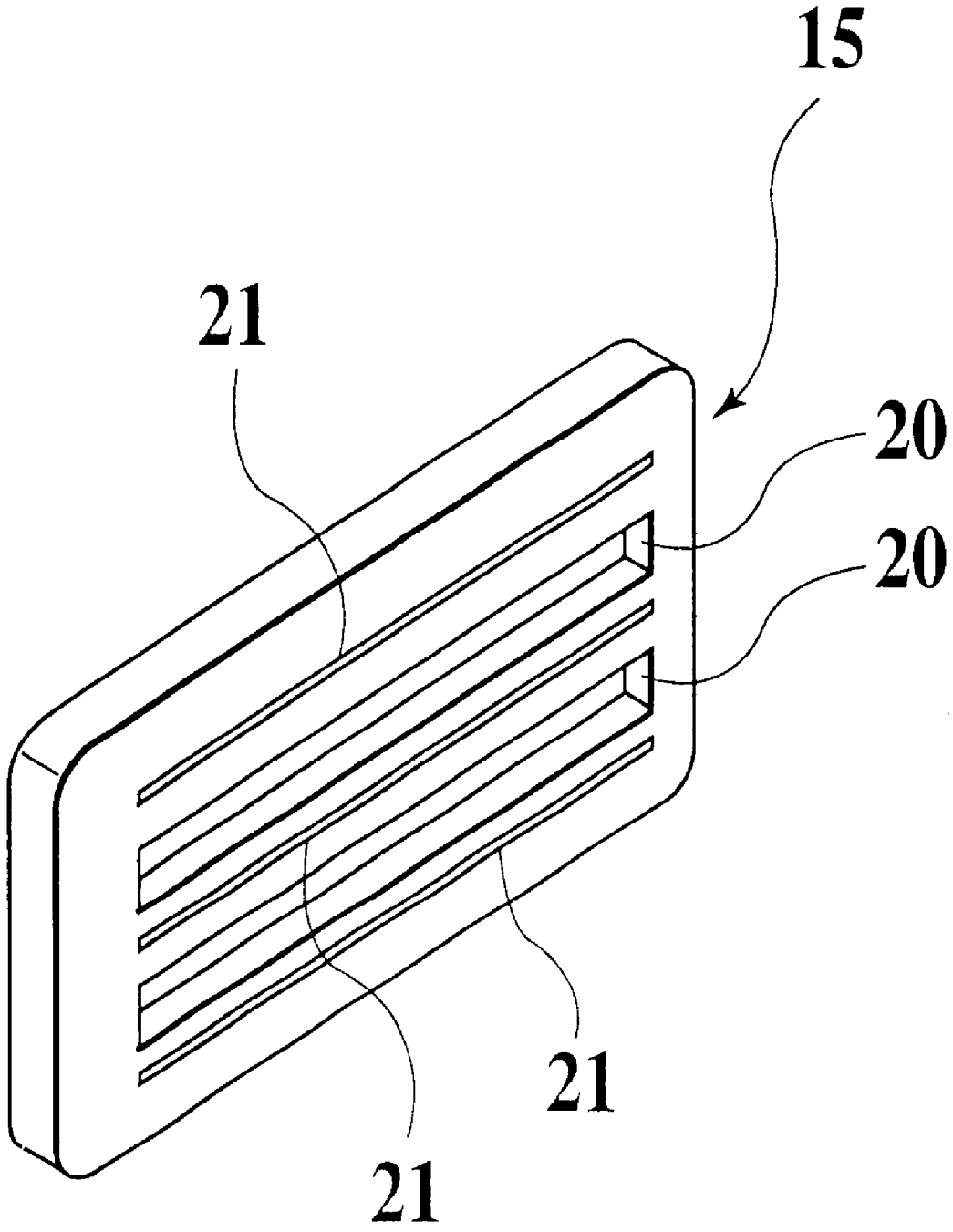
FIG. 2 is a perspective view of the soft sealing material of the first embodiment.
Figure 3B:
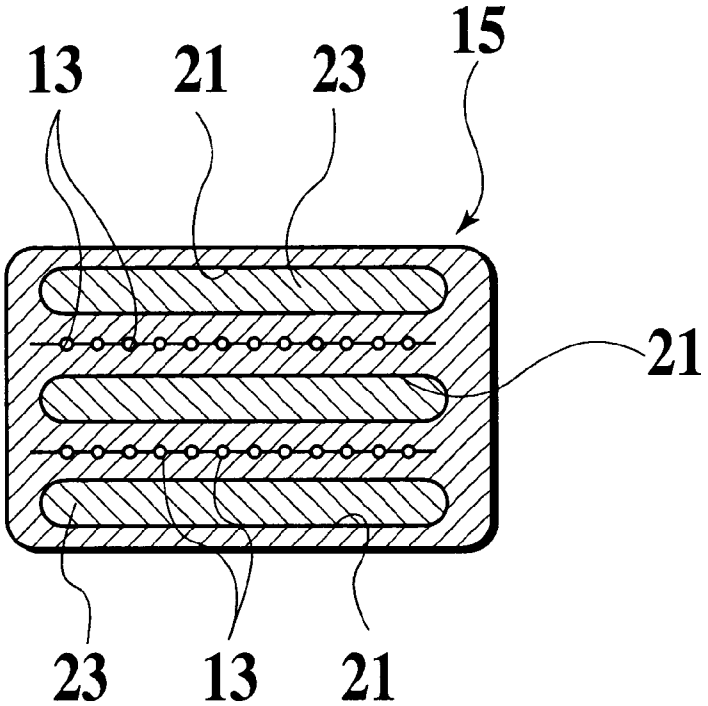
Figure 3A:
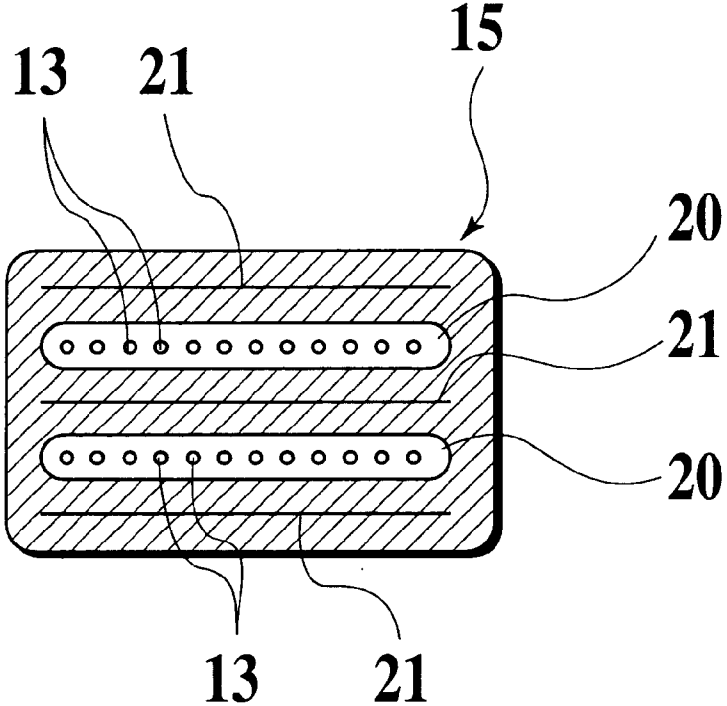

FIG. 1A and FIG. 1B show a waterproof connector of a first embodiment, in which FIG. 1A shows a state before a soft sealing material 15 is pressed, and FIG. 1B, a state after the soft sealing material 15 is pressed. FIG. 2 is a perspective view of the soft sealing material 15. FIG. 3A and FIG. 3B are sections respectively showing states before and after the soft sealing material 15 is pressed.

As shown in FIG. 1A and FIG. 1B, a waterproof connector 10 of the first embodiment comprises a connector housing 12 having terminal accommodation chambers 11, insulation displacement type terminals 14 connected to free ends of insulated electric wires 13 to be accommodated in the terminal accommodation chambers 11, and a soft sealing material 15 accommodated at a draw-out side of the wires 13 of the housing 12. Also, the waterproof connector 10 of the embodiment has pressing and tight-contacting means 16 for pressing the soft sealing material 15 to bring the same into tight-contact with outer circumferences of the wires 13 in a state where the terminals 14 are accommodated in the terminal accommodation chambers 11 and for bringing the soft sealing material 15 into tight-contact with an inner wall 12*a* of a wire passing outlet of the housing 12 in a pressing manner.

The housing 12 has the terminal accommodation chambers 11 formed therein in a two staged manner, to be arranged in upper and lower stages, and a waterproof hood portion 17 is formed around the terminal accommodation chambers 11 integrally therewith. A sealing material accommodating chamber 18 is defined by the wall 12*a* of the wire outlet and communicates with the terminal accommodation chambers 11, at a rear end of the housing 12. Projection-escape portions 19 into which later-described projections 23 are inserted are provided around the terminal accommodation chambers The soft sealing material 15 is made of a body of a gel such as a silicon and formed substantially in a rectangular or parallelepiped normal configuration, as shown in FIG. 2. The soft sealing material 15 is formed at its intermediate portion with insertion holes 20, 20 in a two staged manner. The opening dimensions of each insertion hole 20 are such that the terminal 14 can be inserted through the insertion hole 20, to be smoothly guided by the insertion hole 20 without scraping off an inside of the insertion hole 20. Tow portions of the soft sealing member 15 above the insertion holes 20 and below the insertion holes 20 are formed with slits penetrating therethrough between the front and back surfaces of the soft sealing material 15, and a similar slit 21 is formed between the insertion holes 20, 20. Projections 23 of a spacer 22 are inserted in the slits 21, respectively. The gel of silicon may preferably be replaced by a low-hardness rubber or elastomer. The terminals 14 may be of a solder, a solder-less or crimp type. Each electric wire 13 may preferably be strong enough to support a terminal 14 connected thereto, when the wire 13 is picked up at a longer distance than illustrated and pushed for a guided accommodate of the terminal 14 into a corresponding accommodation chamber 11.

The spacer 22 is fitted in a rear end portion of the housing 12 positioned at the wire draw-out side, i.e. in the wire outlet. The spacer 22 comprises a body 24, wire insertion holes 25, 25 through which the wires 13 are inserted in rows, and the projections 23 inserted into the slits 21. The insertion holes 25 have a diameter larger than a height of each insertion hole 20. An insert groove 27 in which the rear end portion of the housing 12 is inserted is formed at a peripheral portion of the body 24. The projections 23 are provided at portions of the spacer 22 above and below the wire insertion holes 25 and between the wire insertion holes 25, 25, respectively. Each projection 23 is formed at its distal end in a cone or wedge shape.

In a sense, the pressing and tight-contacting means 16 comprises the slits 21 and the projections 23 inserted in the slits 21 to press the soft sealing material 15.

Next, procedures for assembling the waterproof connector 10 will be described. As shown in FIG. 1A, after the soft sealing material 15 is inserted into the sealing material accommodating chamber 18, the terminals 14 connected to the wires 13 are let through the insertion holes 25 of the spacer 22. Then, the terminals 14 are picked up and applied to rear ends of the insertion holes 20 of the soft sealing member 15. Then, the wires 13 are pushed forward, so that the terminals 14 are inserted through, and guided by walls of, the insertion holes 20 into the terminal accommodation chambers 11. When the terminals 14 are accommodated in the chambers 11, the wires 13 have gaps left relative the walls of the insertion holes 20.

Next, the spacer 22 is fitted into the wire outlet of the housing 12, and is pushed toward the terminal accommodation chambers 11, so that the projections 23 are forced into the slits 21. As the projections 23 are forcibly inserted in the slits 21, the soft sealing material 15 is deformed into a sealing configuration, whereby the insertion holes 20 are crushed on the wires 13 or closed shut thereabout. The outer circumference of the soft sealing material 15 is deformed outwardly, so that, as shown in FIG. 1B, the soft sealing material 15 is pressed on or tight-contacts on the inner wall 12*a* of the housing 12 in a watertight sealing manner, and the inner walls of the insertion holes 20 also tight-contact on the outer circumferences of the wires 13. The soft sealing material 15 is thus compressed between a combination of the wall 12*a* and the projections 23 and the wires 13, as well as between a front wall of the wire outlet and a front face of the spacer 24, waterproofing respective associated spaces and gaps.

According to the waterproof connector 10 of the embodiment, as each insertion hole 20 has a sufficient size for a corresponding terminal 14 to be let therethough smooth or without binding, and the terminal 15 is kept from scraping the soft sealing material 15, as well as from carrying scraps into an associated terminal accommodation chamber 11, where it provides an ensured electrical contact.

As the soft sealing material 15 is free from scrapes, it provides a maintained sealing.

In the embodiment described, each terminal 14 is connected in advance to a wire 13, and a corresponding insertion hole 20 is set larger in section than the terminal 14. However, the terminal 14 may be connected to a free end of wire 13 passing the insertion hole 20. In this case, an insertion hole 20 may have a sufficient size for the wire 13 to be let therethrough.

The insertion holes 20 may be provided for terminal accommodation chambers in a one-to-one corresponding manner, and may be arranged in rows and columns so that each insertion hole is centered to a corresponding terminal chamber, as well as to a corresponding insertion hole through a spacer 24. The insertion hole 20 may then have over length a section larger in size than and identical in shape to a largest cross section of the terminal 14 or the insulated electric wire 13, whichever is inserted therethrough and larger.

Incidentally, each insertion hole 25 in the solid spacer 24 has a water-cutting rear edge, where water drops descending along a wire 13 are cut off or have reduced inertial force. Should the wire 13 be directly applied to the insertion hole 20 of the soft sealing material 15, some water drops might have been energized by gravity to attack into sealed gaps, making a bit of water invasion path.

Figure 4A:
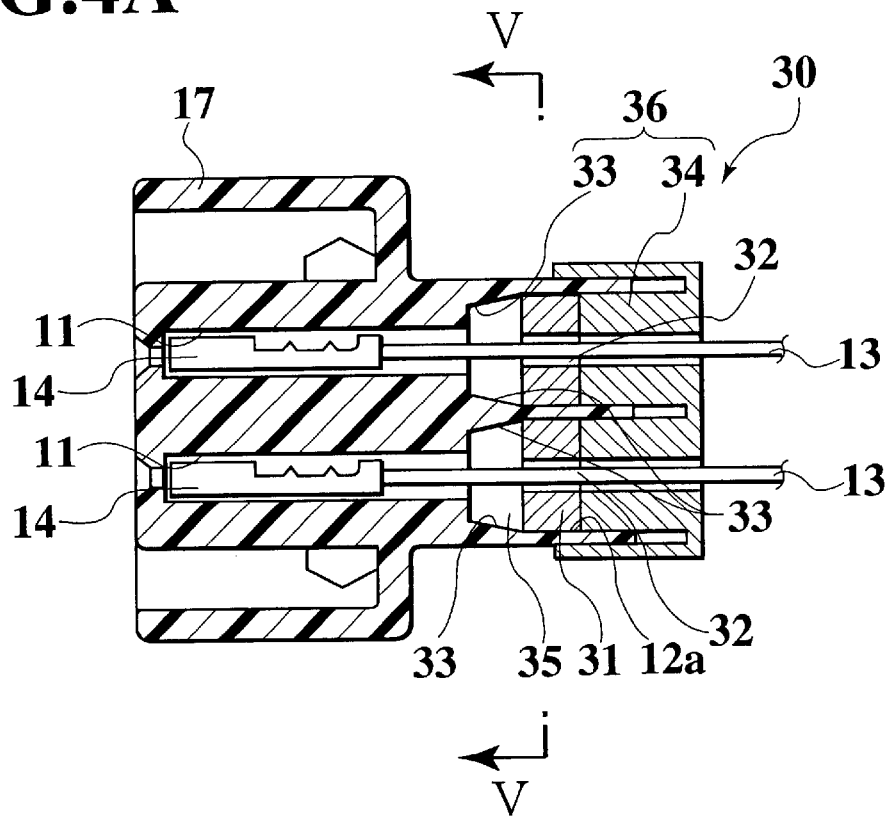
Figure 4A:
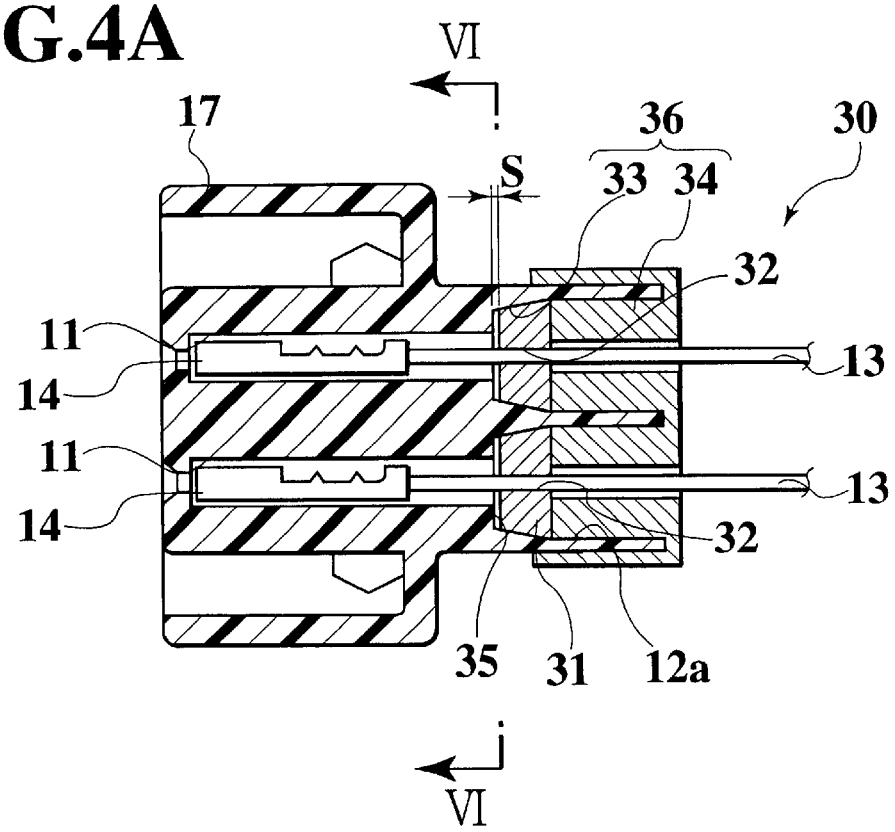
Figure 5:
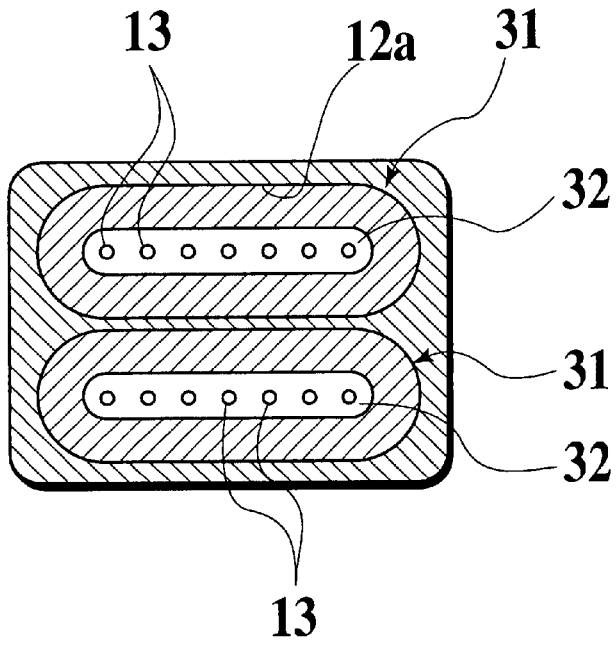
FIG. 5 is a cross-sectional view of the soft sealing material of the second embodiment, in a section along line V—V of FIG. 4A.
Figure 6:
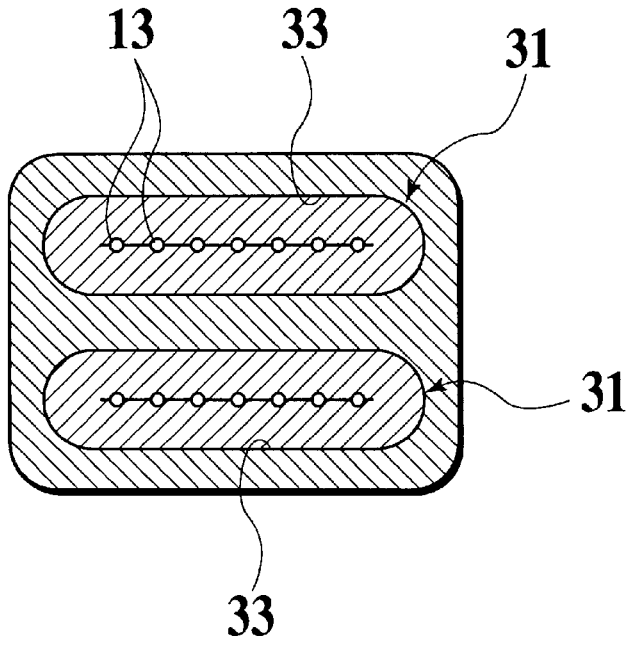
FIG. 6 is a cross-sectional view of the soft sealing material of the second embodiment, in a section along line VI—VI of FIG. 4B.

FIG. 4A and FIG. 4B show a waterproof connector 30 of a second embodiment, and FIG. 5 and FIG. 6 show a pair of upper and lower soft sealing materials 31 of the second embodiment.

As shown in FIGS. 4A and 4B, each soft sealing material 31 of the waterproof connector 30 has an insertion hole 32 through which associated terminals 14 can pass with ease. A pressing and tight-contacting means 36 comprises: taper portions 33 each provided on an inner wall 12*a* of a wire outlet of a connector housing 12, for pressing the soft sealing material 31 to tight-contact on outer circumferences of associated wires 13, when the soft sealing material 31 is displaced; and a pressing member 34 fitted in two wire outlets of the housing 12, for pushing forward the soft sealing materials 31.

The taper portions 33 are formed along front edges of the inner walls 12*a*, which define sealing material accommodation chambers 35, i.e. the wire outlets, of the housing 12 of the waterproof connector 30, around rear ends of terminal accommodation chambers 11. The taper portions 33 are inclined so that inner spaces thereby defined each have a decreasing sectional area, as it approaches the terminal accommodation chambers 11. Accordingly, the soft sealing materials 31 are compressed, as they are pressed by the pressing member 34 fitted in the chambers 35 and pushed forward.

As the pressing member 34 is displaced, as shown in FIG. 4B, each soft sealing material 31 is crushed by the wall of the sealing material accommodation chamber 35, so that an inside of the insertion hole 32 tight-contact on the outer circumferences of the wires 13 in a pressing manner. Likewise, the soft sealing material 31 comes in tight-contact on the taper portion 33, as well.

For fabrication of the waterproof connector 30, as shown in FIG. 4A, the soft sealing materials 31 are placed in the sealing material accommodation chambers 35, and have an initial or normal configuration in which the insertion holes 32 are each larger in section than the terminals 14, and the terminals 14 connected to the wires 13 having passed the pressing member 34 are applied to rear ends of the insertion holes 32 of the soft sealing materials 31 and pushed forward to be accommodated in the terminal accommodation chambers 11. There are left gaps between the wires 13 and the insertion holes 32 in the soft sealing material 31.

Next, the pressing member 34 is applied to rear ends of the wire outlets of the housing 12, and is pushed forward. As associated parts of the pressing member 34 advance in the terminal accommodation chambers 11, as shown in FIG. 4B, the soft sealing materials 31 are displaced toward the terminal accommodation chambers 11 and pressed-against chamber walls, having a compressed sealing configuration. When the soft sealing material 31 is pressed to end, an inside of each insertion hole 32 come into tight-contact on outer circumferences of associated wires 13 and outer surfaces of the soft sealing material 31 tight-contact on the chamber walls including the taper portion 33, as well as on a front face of the pressing member 34. As a result, the soft sealing materials 31 are accommodated between the wires 13 and the inner walls 12*a* of the sealing material accommodation chambers 35 of the housing 12, in a watertight sealing manner.

In the waterproof connector 30, as each insertion hole 32 is larger in sectional size than associated terminals 14, the terminals 14 can pass through the insertion hole with ease, without scraping the soft sealing material 31 nor carrying scraps into the accommodation chambers 11. As a result, the terminals 14 provide an ensured electrical connection to mating terminals.

As the soft sealing materials 31 are free from scrapes, the connector 30 has a maintained waterproof sealing.

In the embodiment, a gap S may be left between the soft sealing material 31 and the wall portion of the sealing material accommodating chamber 35 positioned at the side of the terminal accommodation chambers 11, as it will not affect the sealing performance of the waterproof connector 30.

According to an individual of the embodiment, a waterproof connector comprises: a housing having a terminal accommodation chamber; a terminal connected to an end of an electric wire, to be accommodated in the terminal accommodation chamber; a soft sealing material accommodated to a draw-out side of the housing with respect to the electric wire and adapted for tight-contacting on an outer circumference of the electric wire and on an inner wall of the housing to have the terminal accommodation chamber sealed in; and a combination of configured surfaces as a configuration means, a deformation means, a sealant volume reduction means, a sealant volume displacement means or a pressing tight-contacting means for pressing the soft sealing material to tight-contact the soft sealing material on the outer circumference of the electric wire and on the inner wall of the housing, as the terminal is accommodated in the terminal accommodation chamber.

According to this individual, in a waterproof connector, a soft sealing material is brought into tight-contact with an inner wall of a housing and with an outer circumference of an electric wire in a forcibly deforming manner, by pressing the soft sealing material with a combination of approaching configurations into a compressed sealing state, where it tight-contacts on the outer circumference of the electric wire which is connected to a terminal accommodated in a terminal accommodation chamber. The terminal is guided by an insertion hole into the accommodation chamber. The terminal may be a solder, solder-less, crimp or insulation displacement type. In the case of an insulation displacement type terminal, its wire retention groove has a pair of opposing conductive blades longer than an outside diameter of an insulated electric wire pushed therebetween. Terminal insertion hole of the soft sealing material can be large enough. As the soft sealing material is deformed after accommodation of the terminal, walls of the insertion hole are not scraped by the terminal, and no scrapes are carried in the terminal accommodation chamber.

In other words, the soft sealing material has an initial or normal configuration in which the insertion hole is larger in section all the way therealong than the terminal or the electric wire, whichever is larger in section. After accommodation of the terminal through the insertion hole into the accommodation chamber, the soft sealing material is deformed into a sealing configuration in which the insertion hole has an identical section to the electric wire over a sufficient length for a required sealing around the electric wire.

Or otherwise, the terminal may be accommodated in the accommodation chamber before or after application of the soft sealing material to the housing, and a free end of the electric wire maybe inserted in the accommodation chamber through a larger insertion hole in the soft sealing material, by guiding with walls of the insertion hole and a circumference of an entry of the accommodation chamber onto a wire connection part of the terminal.

According to another individual, the soft sealing material has an insertion hole allowing for the terminal to be inserted therethrough, and a slit neighboring the insertion hole, and the pressing tight-contacting means comprises the slit, and a spacer having a projection to be inserted in the slit for pressing the soft sealing material.

According to this individual, in the waterproof connector, a terminal is inserted through an insertion hole after the soft sealing material is applied to a wire outlet of the housing. The insertion hole is sufficiently larger in section than the terminal, for the terminal to be guided therealong without scraping off an inside of the insertion hole nor carrying scraps into the terminal accommodation chamber. After accommodation of the terminal, a spacer is fitted into the wire outlet and its projection is forced into a slit of the soft sealing material. As a result, the soft sealing material is pressed and deformed, so that the soft sealing material is brought into tight-contact with an inner wall of the wire outlet and an outer circumference of the electric wire.

According to another individual, the soft sealing material has an insertion hole allowing for the terminal to be inserted therethrough. And, the pressing tight-contacting means comprises a taper portion provided at the inner wall of the housing and adapted for pressing the soft sealing material to tight-contact on the outer circumference of the electric wire, as the soft sealing material is moved, and a pressing member attached to the draw-out side with respect to the electric wire, for moving the soft sealing material.

According to this individual, in the waterproof connector, a terminal is inserted through an insertion hole to be accommodated in a terminal accommodation chamber, after application of the soft sealing material to a wire outlet of the housing. The insertion hole is sufficiently larger in section than the terminal, for the terminal to be guided therealong to the accommodation chamber without scraping off an inside of the soft sealing material nor carrying scraps into the accommodation chamber. After the terminal is accommodated in the chamber, a pressing member is fitted in the wire outlet, thereby pressing the soft sealing material against inner walls of the housing. As the soft sealing material is wholly or partially displaced relative to the housing walls, it progressively tight-contacts on a tapered wall portion, whereby it is deformed into a compressed configuration and tight-contacts on an outer circumference of the electric wire, as well as on the walls of the housing.

While preferred embodiments of the present invention have been described using specific terms, such description is for illustrative purpose, and it is to be understood that changes and variations may be made without departing from the spirit or scope of the following claims.

What is claimed is:

1. A waterproof connector comprising:

a plurality of terminals, each terminal being connected to an electric wire;

a housing having a chamber for accommodating the terminal and an opening for passing the electric wires;

a flexible sealing body in the opening of the housing having an insertion hole through which the terminals pass through into the chamber, the flexible sealing body being radially compressed about the electric wires; and means for deforming the flexible sealing body from an initial configuration thereof, where the insertion hole is larger in section than the plurality terminals, to the sealing configuration, where the flexible sealing body is maintained under radial compression, the insertion hole being compressed about the electric wires arranged in the insertion hole of the flexible sealing body, wherein the means for deforming the flexible sealing body acts toward a region of the flexible sealing body close to each electric wire and deforms the flexible sealing body into the sealing configuration, the region of the flexible sealing body close to each electric wire including portions of the flexible sealing body that are symmetrically disposed around a circumference of a cross-section of each electric wire and perpendicular to a direction in which the each electric wire extends.

2. The waterproof connector of claim 1, wherein the means comprises a cut in the flexible sealing body, and an insert forced in the cut.

3. The water proof connector of claim 1, wherein the means comprises an inclined wall of the opening pressing on the flexible sealing body, and a push member for pushing the flexible sealing body.

4. A waterproof connector comprising:

a housing having a terminal accommodation chamber;

a plurality of terminals, each terminal connected to an end of an electric wire, to be accommodated in the terminal accommodation chamber;

a radially compressed flexible sealing material accommodated to a draw out side of the housing with respect to the electric wires and tightly contacting on an outer circumference of each electric wire and an inner wall of the housing to seal the terminal accommodation chamber; and pressing tight contacting means for pressing the flexible sealing material into tight-contact with the flexible sealing material on the outer circumference of each electric wire and the inner wall of the housing, as the terminal are accommodated in the terminal accommodation chamber, wherein the pressing tight-contacting means applies radial compression through the flexible sealing body and at least along an arrangement direction of the electric wires arranged in an insertion hole of the flexible sealing body, and wherein the pressing tight contacting means acts toward a region of the flexible sealing material close to each electric wire and applies the radial compression to the flexible sealing material, the region of the flexible sealing material close to each electric wire including portions symmetrically positioned with respect to each other and with respect to a circumference of a cross-section of each electric wire and perpendicular to a direction in which the each electric wire extends.

5. The waterproof connector of claim 4, wherein the flexible sealing material has a slit neighboring the insertion hole, and wherein the pressing tight-contacting means comprises the slit, and a spacer having a projection to be inserted in the slit for pressing the flexible sealing material.

6. The waterproof connector of claim 4, wherein the pressing tight-contacting means comprises a taper portion provided at the inner wall of the housing pressing the flexible sealing material into tight-contact on the outer circumference of the electric wire, as the flexible sealing material is moved, and a pressing member attached to the draw-out side with respect to the electric wire, for moving the flexible sealing material.

7. A waterproof connector fabrication method comprising the steps of:

providing a housing having a chamber with an opening;

providing a plurality of electric wires and a plurality of terminals;

connecting each terminal to a respective one of the electric wires;

providing a flexible sealing body with an initial configuration thereof having an insertion hole larger in section than the plurality of terminals;

inserting the plurality of terminals through the insertion hole to the chamber, thereby accommodating the plurality of terminals in the chamber with the plurality of electric wires passing through the opening, and;

radially compressing the flexible sealing body to deform the flexible sealing body from the initial configuration thereof to a sealing configuration thereof in which the insertion hole has an identical section to the electric wires, to apply the radial compression at least along an arrangement direction of the plurality of electric wires arranged in the opening of the flexible sealing body, thereby sealing the opening, wherein a region of the flexible sealing body close to each electric wire is acted upon such that the flexible sealing body is deformed into the sealing configuration, the region of the flexible sealing body close to each electric wire including portions symmetrically positioned with respect to each other and with respect to a circumference of a cross-section of each electric wire and perpendicular to a direction in which the each electric wire extends.

8. The waterproof connector of claim 1, wherein the plurality of electric wires forms a row in a cross-section of the flexible sealing body and the region where the means for deforming the flexible sealing body acts extends in parallel with a direction in which the row of the plurality of electric wires extends.

9. The waterproof connector of claim 1, wherein the plurality of electric wires forms a row in a cross-section of the flexible sealing body and the region where the means for deforming the flexible sealing body acts surrounds a portion of the row of the plurality of electric wires in a direction perpendicular to the direction in which each wire extends.

* * * * *